US006792117B2

(12) United States Patent
Liu

(10) Patent No.: US 6,792,117 B2
(45) Date of Patent: Sep. 14, 2004

(54) ORIENTATION ADJUSTING APPARATUS FOR SPEAKERS

(75) Inventor: Ping-Hsiung Liu, Taipei (TW)

(73) Assignee: Calix Technology Co., Ltd., Tainan (TW)

( * ) Notice: Subject to any disclaimer, the term of this patent is extended or adjusted under 35 U.S.C. 154(b) by 384 days.

(21) Appl. No.: 10/084,950

(22) Filed: Mar. 1, 2002

(65) Prior Publication Data

US 2003/0165244 A1 Sep. 4, 2003

(51) Int. Cl.[7] ..... H04R 1/02

(52) U.S. Cl. ..... 381/87; 381/386; 381/387; 381/124; 181/150

(58) Field of Search ..... 381/87, 332–335, 381/150, 182, 386, 387, 390, 395, 124; 181/150, 179, 197, 199

(56) References Cited

U.S. PATENT DOCUMENTS 3,888,333 A * 6/1975 Yamaguchi ..... 181/143
5,321,760 A * 6/1994 Gray ..... 381/86
5,677,669 A * 10/1997 Walkley et al. ..... 340/473
6,215,883 B1 * 4/2001 Leonarz ..... 381/182
6,343,135 B1 * 1/2002 Ellero et al. ..... 381/387
6,467,908 B1 * 10/2002 Mines et al. ..... 353/28

* cited by examiner

*Primary Examiner*—Xu Mei
(74) *Attorney, Agent, or Firm*—Rosenberg, Klein & Lee

(57) ABSTRACT

An orientation adjusting apparatus for a speaker set has a moving device, which is received in a housing, and includes a first motor, a second motor, a co-moving wheel, and an up and down movably frame biased upwards by springs. The first motor comes into contact with a top of the frame at a depressing wheel thereof. The second motor is secured to the frame, and has a second wheel. The co-moving wheel is connected to the frame. When the first, and the second motors are activated, the frame will be moved down by means of the depressing wheel for both the second wheel and the co-moving wheel to stick out from the bottom of the housing to come into contact with the ground, and the housing will be moved left and right by means of the second wheel with a rear support leg thereof as a pivot.

7 Claims, 10 Drawing Sheets

ORIENTATION ADJUSTING APPARATUS FOR SPEAKERS

BACKGROUND OF THE INVENTION

The present invention relates to an orientation adjusting apparatus for speakers, more particularly an orientation adjusting apparatus, which allows the user to easily adjust the orientation of the speakers in relation to him while he is sitting in front of the same to listen to the music and speeches sent out therefrom.

It is an important task to place speakers at a proper distance from the listener and with an appropriate orientation for the listener to enjoy the optimal sound effects. Several problems would occur in adjusting the orientation of speakers in relation to the listeners:

1. In adjusting the orientation of the speakers, one person has to sit in front of the same while another person is moving the same such that the orientation for optimal sound effects can be easily found out. In other words, it needs two persons to perform the adjustment.

2. If there is only person present, this person has to walk between the speakers and the listener's seat many times for moving the speakers and for checking the sound sent out from the speakers before the orientation for the optimal sound effects is found out. Therefore, it is time-consuming and exhausting for only one person to adjust the orientation of speakers for getting optimal sound effects.

3. Moving the speakers alone is also an exhausting and difficult task.

SUMMARY OF THE INVENTION

Therefore, it is a main object of the present invention to provide an orientation adjusting apparatus for speakers, which allows one person to easily adjust the orientation of the speakers in relation to him while he is sitting on the audience seat in front of the same to listen to the sound sent out therefrom.

The orientation adjusting apparatus for a speaker set includes a housing member, a first moving device, and a second adjusting device. The housing member has two through holes on a front portion of a bottom, and two front support legs, and a rear support leg on the bottom. The first moving device is received in the housing member; the first moving device including an up and down movably frame biased upwards by springs.

The first moving device has a first motor coining into contact with an upper side of the frame at a depressing wheel eccentrically connected to a shaft of the motor; a second motor secured to the frame for a second wheel connected to a shaft of the second motor to oppose one of the through holes, and a co-moving wheel turnably connected to the frame to oppose other one of said through holes. A first speaker is disposed in the housing member such that it can be adjusted in respect of orientation in relation to an audience seat by means of activating the first, and the second motors for said second wheel and said co-moving wheel to stick out through said through holes so as to come into contact with the ground, and for moving the housing member left and right with said rear support leg as a pivot respectively.

The second adjusting device has an upper support tube pivoted to a bottom of a second speaker disposed above the housing member at an upper end; the second speaker being pivoted to a support member at a middle portion; the second adjusting device having a lower support tube supported on an upper side of the housing member at a lower end; the lower tube being connected to a lower end of the upper tube from an upper end in such a manner as to allow a length of said second adjusting device to be changed for adjustment of orientation of the second speaker.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
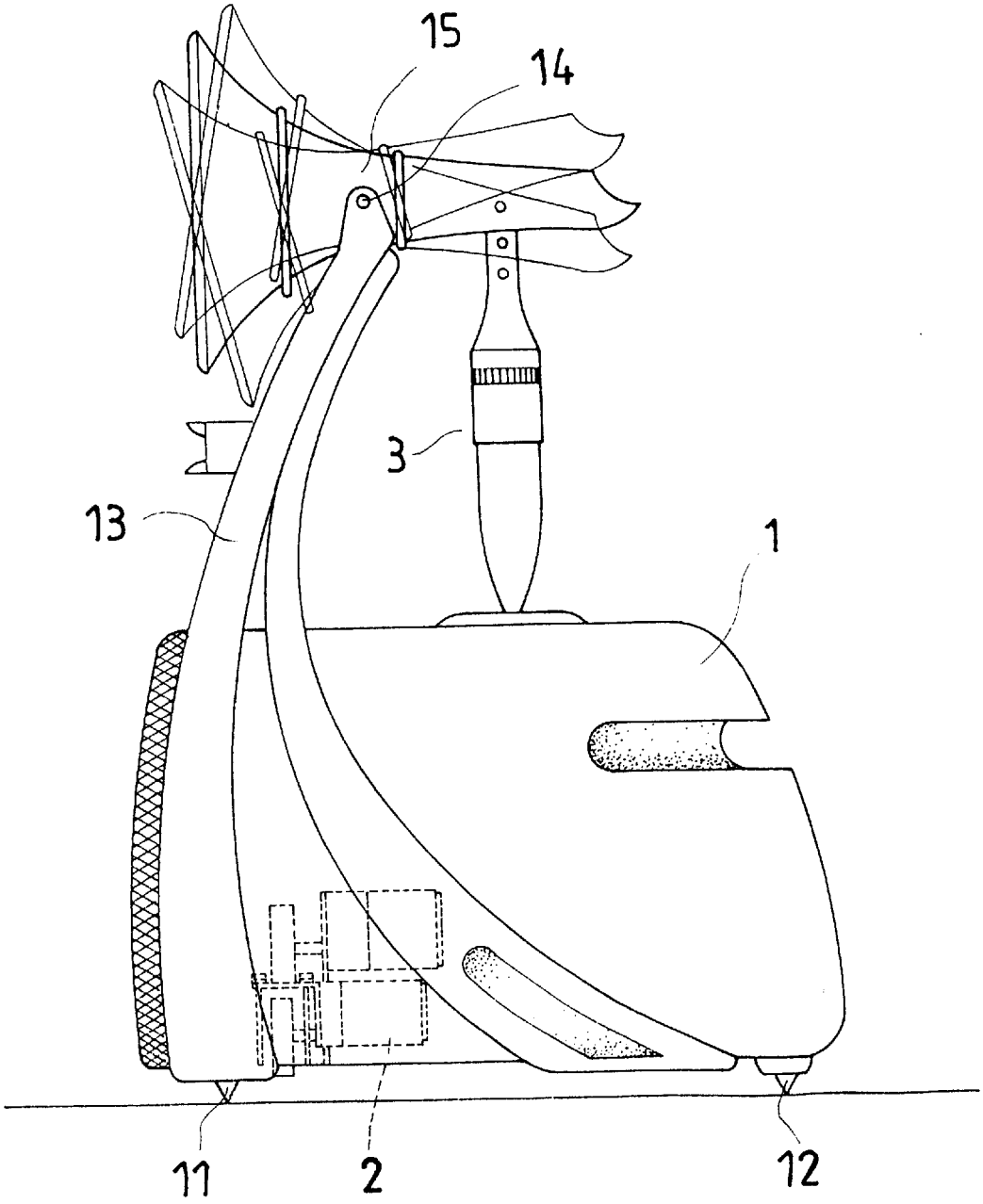
FIG. 1 is a side view of a speaker set with an orientation adjusting apparatus of the present invention.
Figure 2:
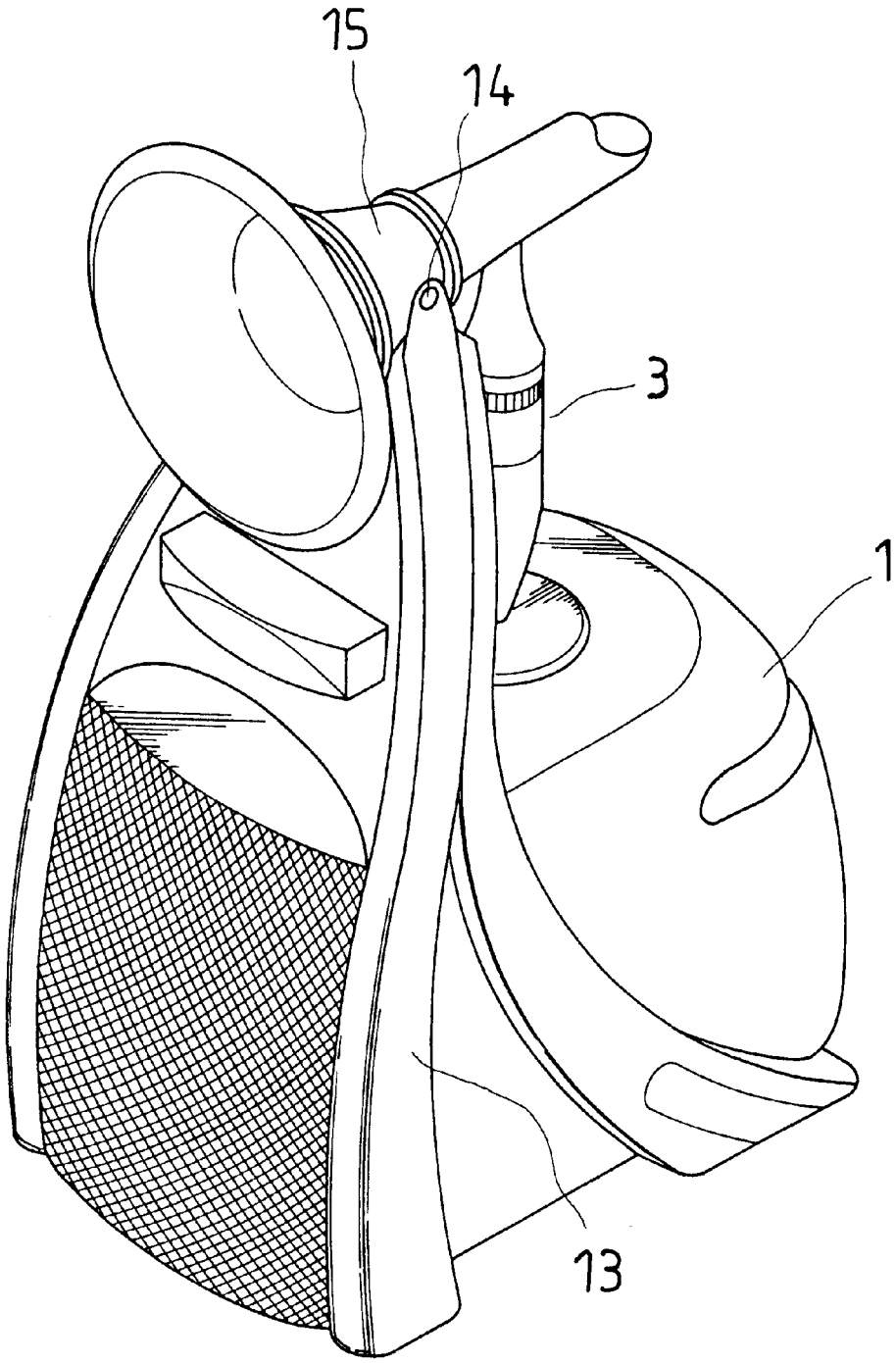
FIG. 2 is a perspective view of a speaker set with an orientation adjusting apparatus of the present invention.
Figure 3:
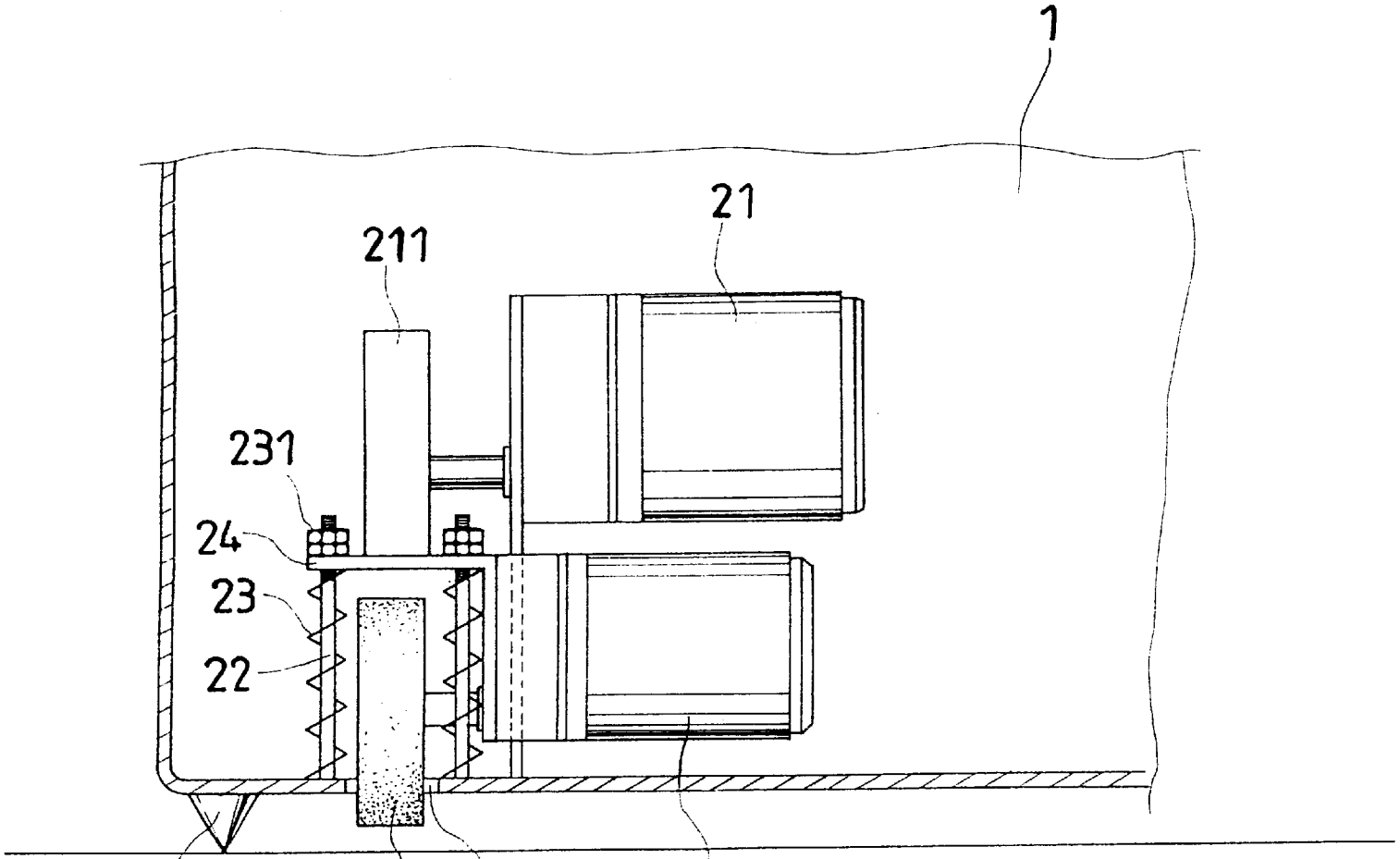
FIG. 3 is a side view of the first moving device of the orientation adjusting apparatus of the present invention.
Figure 4:
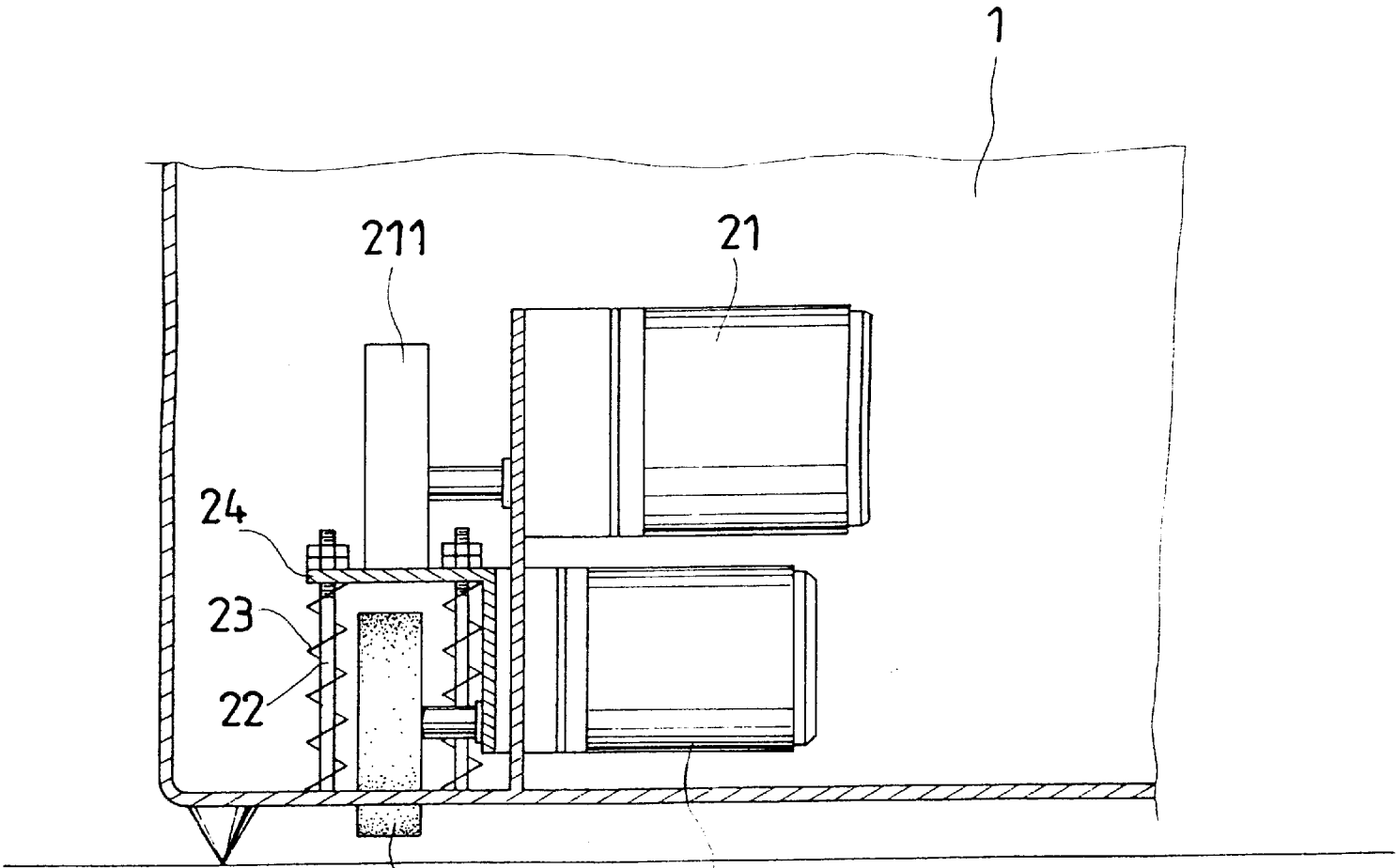
FIG. 4 is another side view of the first moving device of the orientation adjusting apparatus of the present invention.
Figure 5:
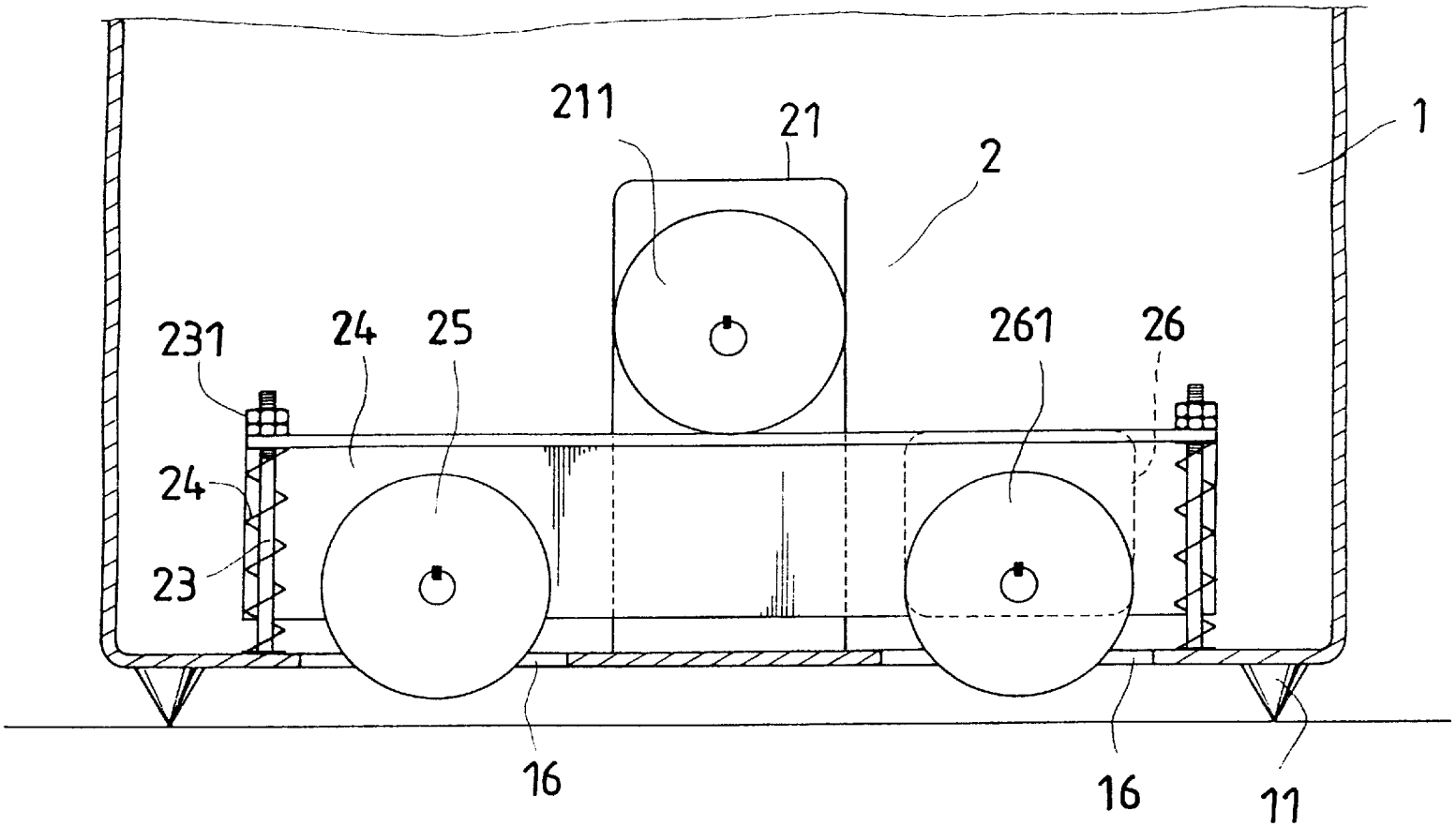
FIG. 5 is a front view of the first moving device of the orientation adjusting apparatus of the present invention.
Figure 6:
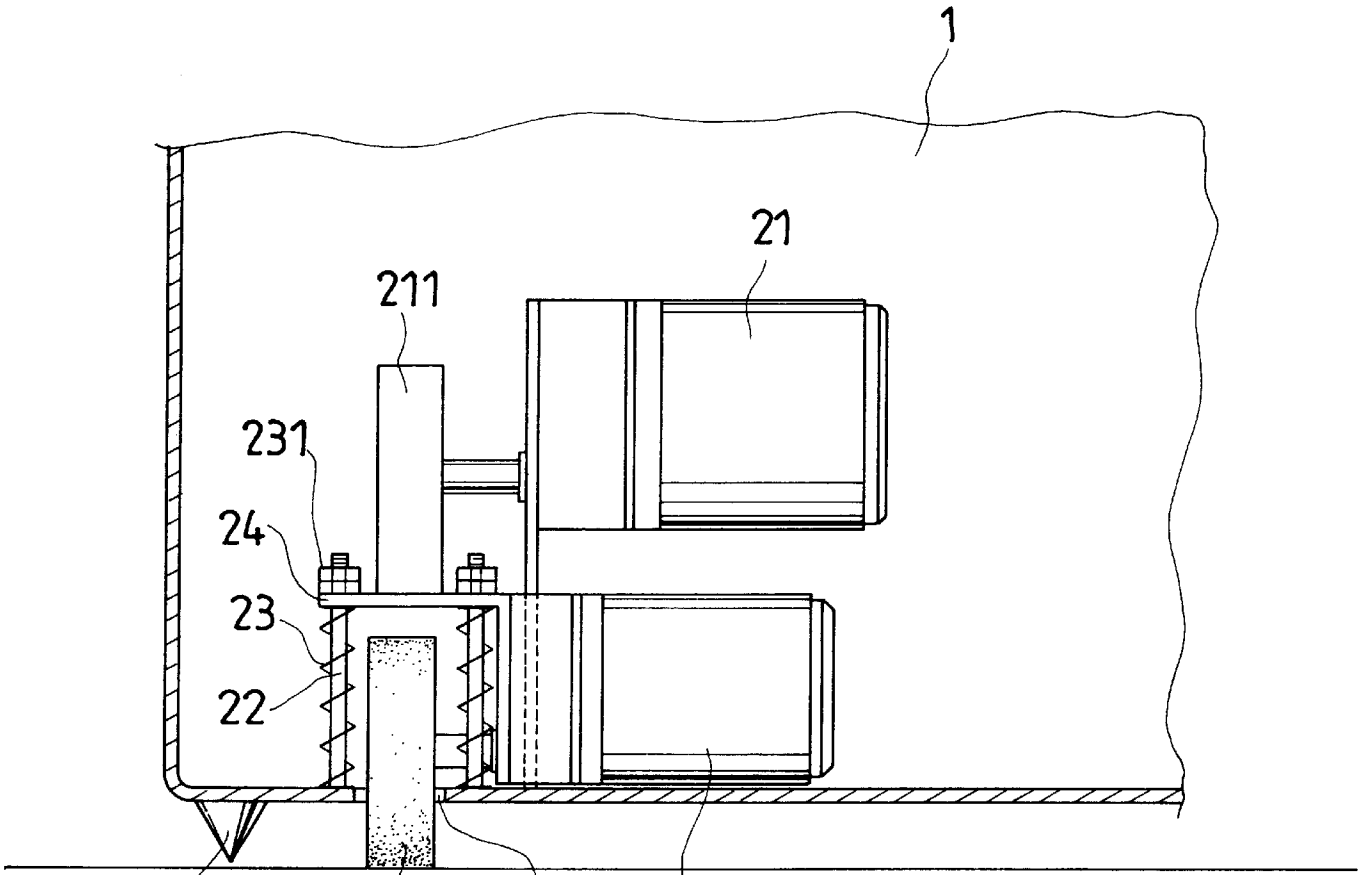
FIG. 6 is a side view of the first moving device being operated to change the position of the housing according to the present invention.
Figure 7:
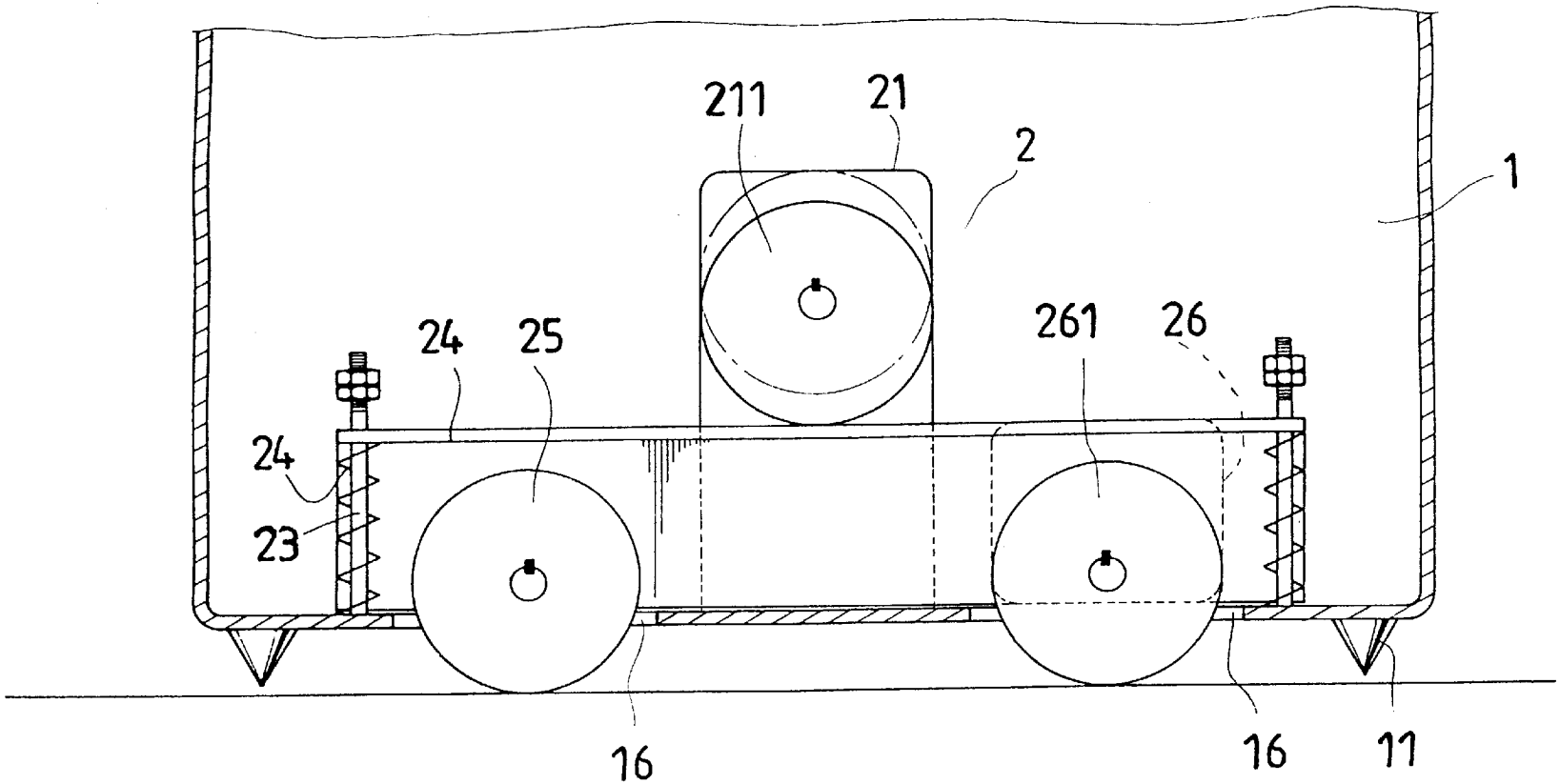
FIG. 7 is a front view of the first moving device.

Referring to FIGS. 1, 2, 3, and 4 a set of speakers with an orientation adjusting apparatus according to the present invention include a housing member 1, a first moving device 2, a first speaker (not shown), a second adjusting device 3, a support member 13, and a second speaker 15.

The first speaker; and the first moving device 2 are disposed in the housing member 1. The housing member 1 has two front support legs 11 provided on the front portion of the bottom thereof, and a rear support leg 12 on the rear portion of the bottom; the rear support leg 12 tapers off towards the lower end. Two through holes 16 are formed on the front portion of the bottom of the housing member 1.

The first device 2 includes a first motor 21, a second motor 26, a frame 24, four guiding rods 22, and a co-moving wheel 25. The first motor 21 is fixed in position in the housing member 1, and has a depressing wheel 211, which is connected to a shaft (not numbered) of the motor 21 at a hole formed a distance from the center. The guiding rods 22 stick up from the bottom of the housing member 1 beside the outward edges of the through holes 16; the guiding rods 22 each has threads on the upper end portion. The frame 24 includes a horizontal board portion and an upright board portion, and is up and down movably disposed under the depressing wheel 211 of the motor 21 with the upper end threaded portions of the guiding rods 22 passing through the corners of the horizontal board portion thereof; the guiding rods 22 are each passed through a spring 23 before the frame 24 is connected thereto such that the frame 24 is biased up by the springs 23. Nuts 231 are screwed onto the upper threaded portions of the guiding rods 22 after the frame 24 is connected to the guiding rods 22; thus the frame 24 is stopped from falling off.

The second motor 26 is secured to the upright portion of the frame 24, and is connected to a center of a second wheel 261 from a front end of a shaft (not numbered) thereof such that the second wheel 261 oppose a first one of the through holes 16. The co-moving wheel 25 is connected to a third shaft (not numbered) turnably connected to the upright portion of the frame 24 such that it opposes the other through hole 16 of the housing member 1.

The housing member 1 is supported by the support legs 11, 12 when the springs 23 bias the frame 24 up for the wheels 25, and 261 to be completely received in the housing member 1. The housing member 1 is supported on the rear support leg 12, the second wheel 261, and the co-moving wheel 25 when the first motor 21 is activated so as to cause the depressing wheel 211 to make the frame 24 move down relative to the housing member 1.

Thus, the front portion of the housing member 1 can be moved left and right with the rear support leg 13 being used as the pivot for changing the orientation of the housing member 1 when the second motor 26 is activated.

The support member 13 is connected to the outer side of the housing member 1 and sticks up from the tipper side of the same. The second speaker 15 is pivoted to the upper ends of the support member 13 at the middle portion by means of a pivotal rod 14.

Figure 8:
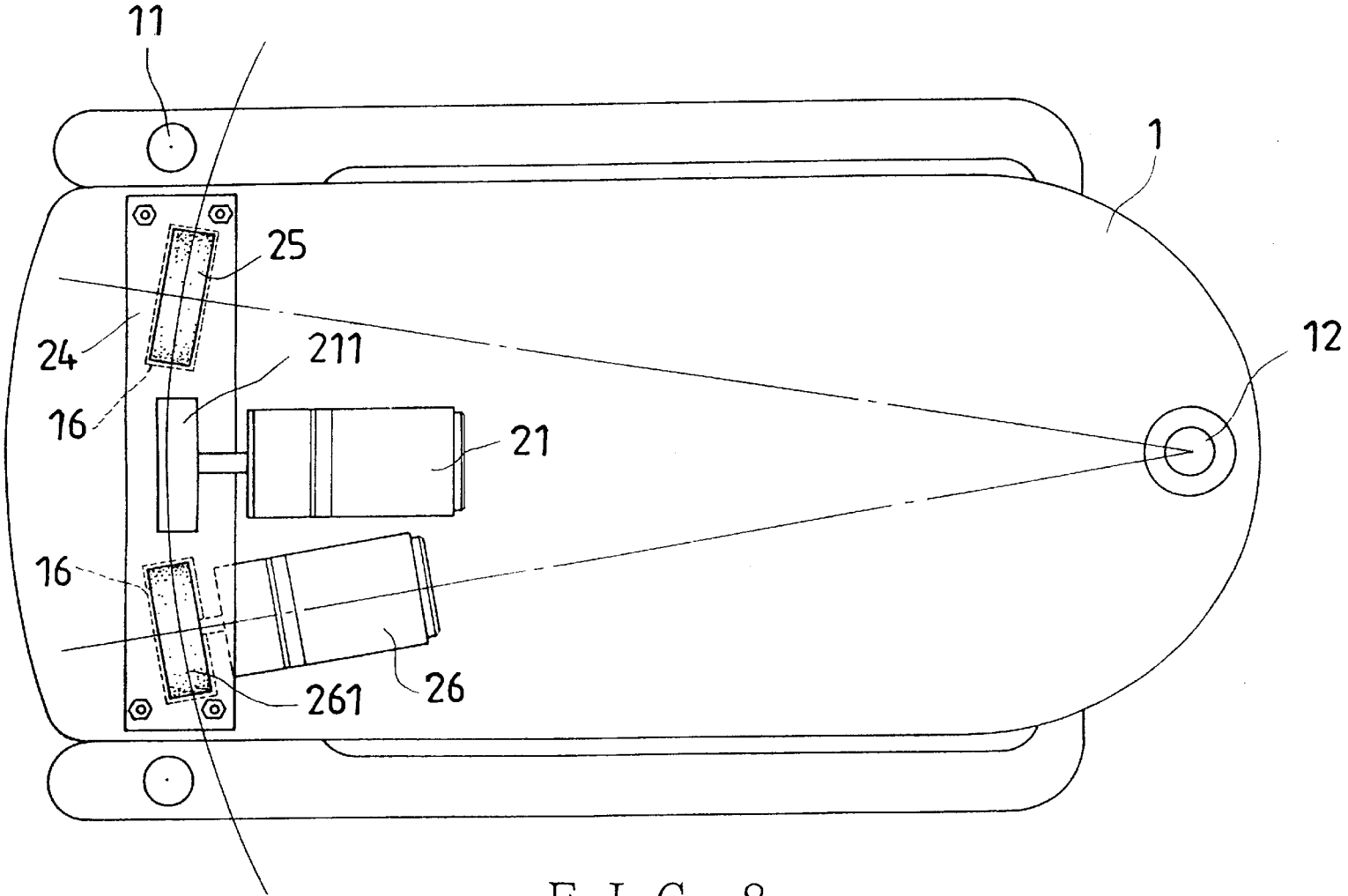
FIG. 8 is a bottom view of the adjusting apparatus according to the present invention.
Figure 9:
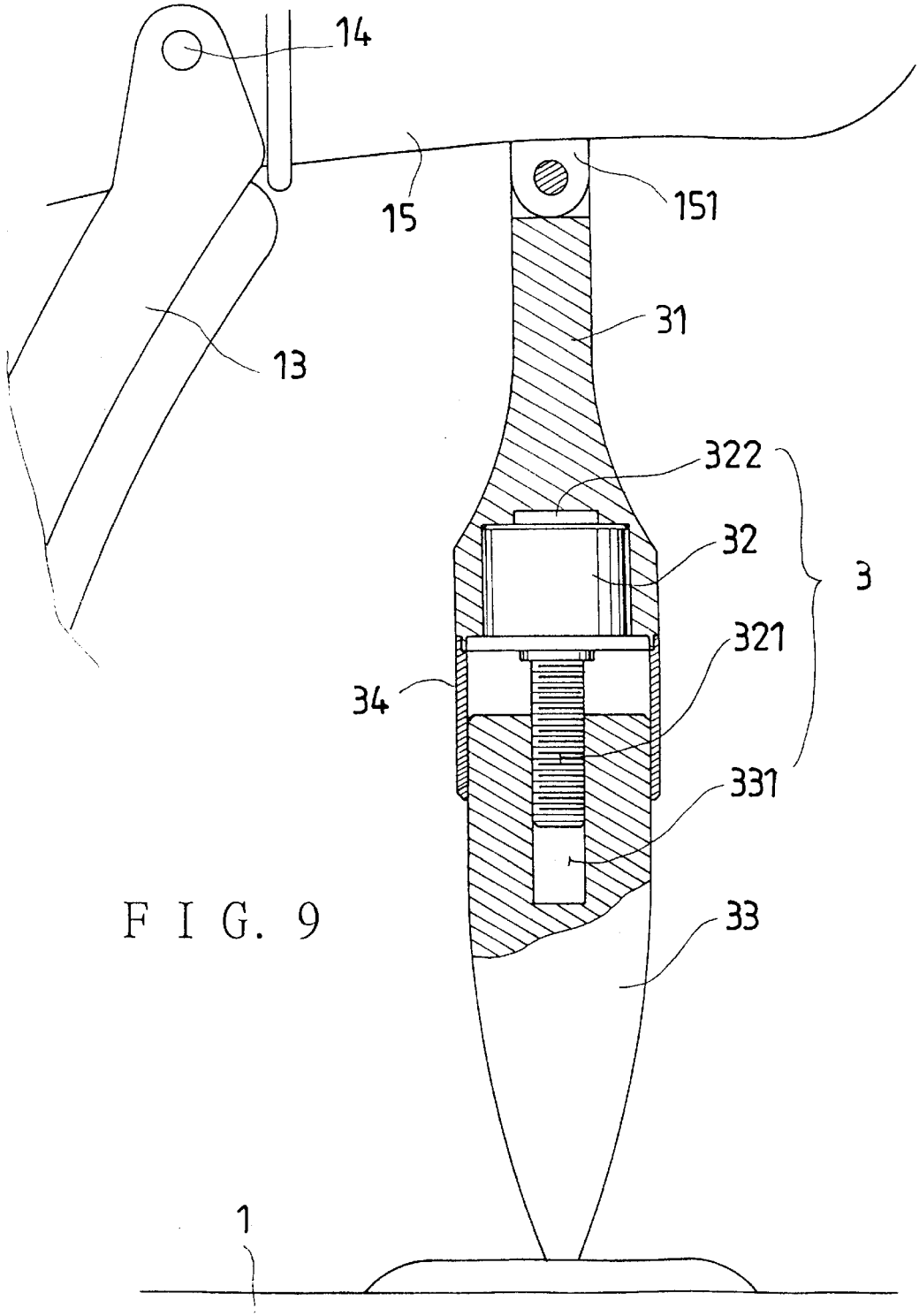
FIG. 9 is a cross sectional view of the second adjusting device of the present invention.

The second adjusting device 3 is pivoted to a holed connecting protrusion formed on the bottom of a rear portion of the second speaker 15 from an upper end of an upper support tube 31 thereof, and is supported on the housing member 1 at a lower end of a lower support tube 33 thereof, referring to FIG. 8, the lower end of the upper tube 31 is provided with a third motor 32, which has a threaded shaft 321 sticking down therefrom to be screwed into a threaded hole 331 of the upper portion of the lower tube 33 such that the height of the second adjusting device 3 can be changed when the threaded shaft 321 is turned on activation of the third motor 32. Therefore, the front portion of the second speaker 15 can be moved up and down for adjustment of orientation of the same by means of controlling the motor 32. Furthermore, an ornamental ring 34 is connected to the lower end of the upper support tube 31 to enclose the part of the threaded shaft 321 that is not screwed into the threaded hole 331.

Figure 10:
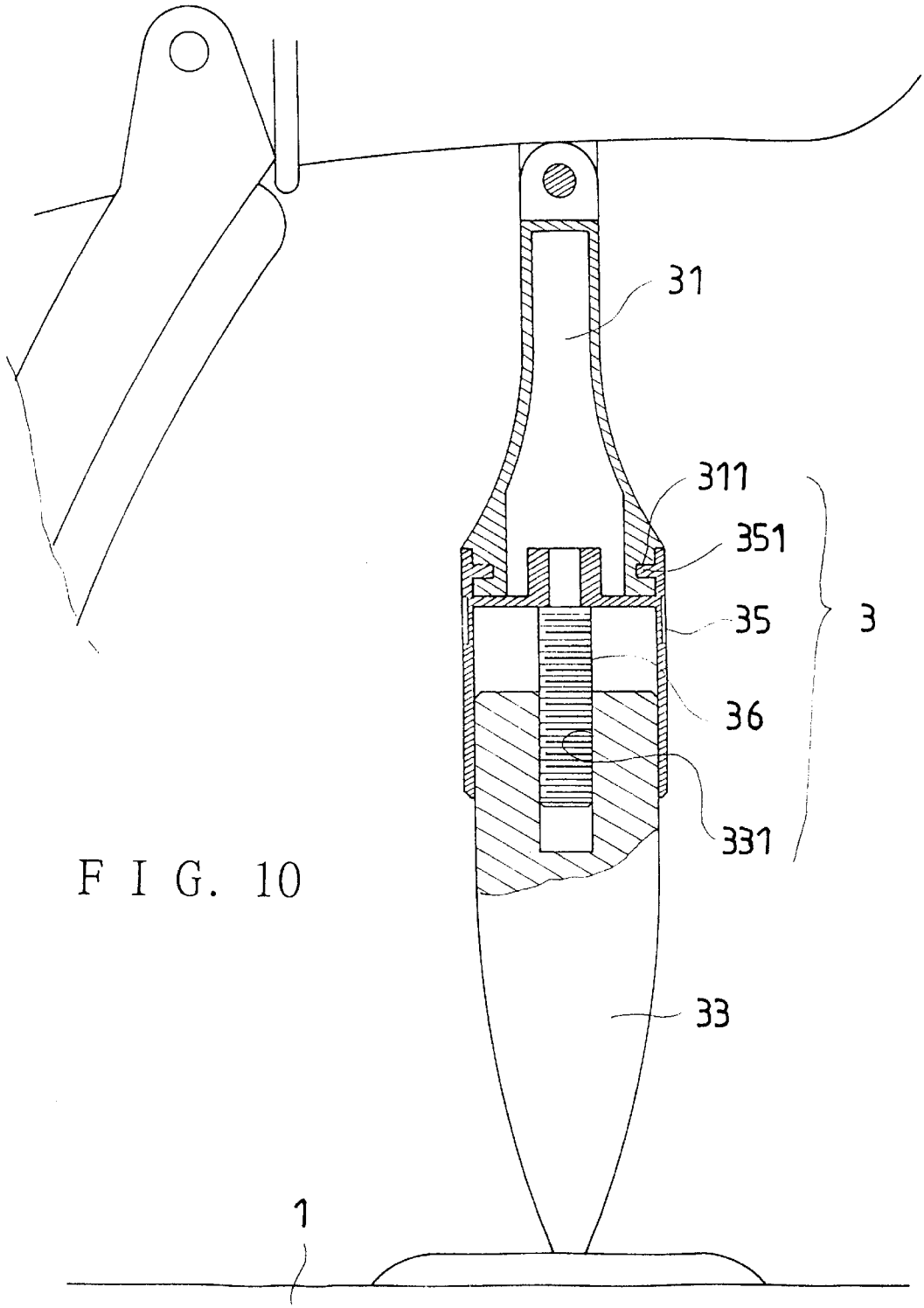
FIG. 10 is a cross sectional view of the second adjusting device of the second embodiment.

Referring to FIG. 10, the second adjusting device 3 is provided with a turnable member 35 in placed of the motor 32; the turnable member 35 has a threaded rod 36 sticking down from the center, and is fitted onto an annular trench 311 of the upper support tube 31 from an annular protrusion 351 thereof; the threaded rod 36 is screwed into the threaded hole 331 of the lower tube 33 such that the height of the second adjusting device 3 can be changed for adjustment of orientation of the speaker 15 by means of turning the tunable member 35.

All of the motors 21, 26, and 32 are provided in such a manner that they can be controlled by a remote control (not shown) for allowing one person to adjust the orientation of the speaker sets when he is sitting in front of same to listen to the sound sent out from same. The remote control is known by those skillful in the related field, and is not the subject of the present invention, therefore it is not detailed here.

From the above description, it can be easily understood that the orientation adjusting device of the present invention has advantages as followings:

1. The orientation adjusting device can be easily operated by one person to change the position of the speakers.

2. One person can sit in front of the speakers to adjust the position of the same with the remote control while the speakers are sending out sound such that he can easily and effortlessly find out the optimal position of the speakers for desired sound effects without having to walk between the audience seat and the speakers.

3. Position of the first speaker can be adjusted by controlling the first and the second motors 21, and 26, while position of the second speaker can be adjusted by controlling the second adjusting device 3 as well as the first moving device 2. Therefore, one doesn't have to move the speaker set manually in adjusting the orientation of the same.

What is claimed is:

1. An orientation adjusting apparatus for a speaker set, comprising a housing member, said housing member having two through holes on a front portion of a bottom thereof, said housing member having two front support legs, and a rear support leg oil the bottom; said housing member having a first moving device received therein; said first moving device including an up and down movably frame; said frame being biased upwards by springs;

said first moving device having a first motor coming into contact with an upper side of said frame at a depressing wheel eccentrically connected to a shaft of said motor; said first moving device having a second motor secured to said frame for a second wheel connected to a shaft of said second motor to oppose one of said through holes; said first moving device having a co-moving wheel turnably connected to said frame to oppose other one of said through holes;

whereby a first speaker of said speaker set disposed in said housing member can be adjusted in respect of orientation in relation to an audience seat by means of activating said first, and said second motors for said second wheel and said co-moving wheel to be moved down so as to stick out through said through holes to come into contact with a ground, and for moving said housing member left and right with said rear support leg as a pivot respectively.

2. The orientation adjusting apparatus of claim 1 further comprising a second adjusting device; said second adjusting device having an upper support tube pivoted to a bottom of a second speaker disposed above said housing member at an upper end; said second speaker being pivoted to a support member at a middle portion thereof; said second adjusting device having a lower support tube supported on an upper side of said housing member at a lower end; said lower tube being connected to a lower end of said upper tube from an upper end in such a manner as to allow a length of said second adjusting device to be changed for adjustment of orientation of said second speaker.

3. The orientation adjusting apparatus of claim 2, wherein a third motor is secured to said lower end of said upper tube with a threaded shaft sticking downwards to be screwed into a threaded hole of said lower tube; said motor being controlled by a remote control for changing the length of said second adjusting device; a ring being connected to said upper tube for enclosing a portion of said threaded shaft that is not screwed into said threaded hole.

4. The orientation adjusting apparatus of claim 2, wherein a turnable member is turnably fitted to said lower end of said upper tube with a downwards sticking threaded rod being screwed into a threaded hole of said lower tube, thus allowing the length of said second adjusting device to be changed by means of turning said turnable member relative to said lower tube.

5. The orientation adjusting apparatus of claim 1, wherein said rear support leg tapers off towards a lower end.

6. The orientation adjusting apparatus of claim 4, wherein said turnable member has an annular protrusion on an inner side thereof to be fitted onto an annular trench of an outer side of said upper tube.

7. The orientation adjusting apparatus of claim 1, wherein said motors are controlled by a remote control for adjusting orientation of said first speaker.

* * * * *